United States Patent [19]

Mizelle

[11] 4,236,260

[45] Dec. 2, 1980

[54] SOFA SLEEPER WITH POLYPROPYLENE DECK ASSEMBLY

[75] Inventor: Ned W. Mizelle, Lexington, Ky.

[73] Assignee: Hoover Universal, Inc., Saline, Mich.

[21] Appl. No.: 43,148

[22] Filed: May 29, 1979

[51] Int. Cl.[3] ..... A47C 17/13; B23P 11/02

[52] U.S. Cl. ..... 5/13; 5/187

[58] Field of Search ..... 5/13, 27, 51 D, 186 R, 5/187

[56] References Cited

U.S. PATENT DOCUMENTS

| | | | |
|---|---|---|---|
| 2,878,490 | 3/1959 | Schneider | 5/13 |
| 3,482,270 | 12/1969 | Hill | 5/187 |
| 3,636,574 | 1/1972 | Kravitt | 5/186 |
| 3,805,367 | 4/1974 | Hasty | 5/187 |
| 3,860,351 | 11/1958 | LaRussa | 5/187 |

*Primary Examiner*—Casmir A. Nunberg

*Attorney, Agent, or Firm*—Olsen and Stephenson

[57] ABSTRACT

A polypropylene fabric for a sofa sleeper mechanism which includes a conventional foldable frame having a plurality of relatively movable sections that are movable between side-by-side, bed-forming positions and vertically stacked seat-forming positions. The polypropylene fabric is mounted on the frame so as to form a yieldable support surface for a mattress or the like in the bed-forming position of the frame and also has the capability of functioning as the direct support for the usual sofa seat cushions in the seat-forming position of the frame.

1 Claim, 4 Drawing Figures

SOFA SLEEPER WITH POLYPROPYLENE DECK ASSEMBLY

BACKGROUND OF THE INVENTION

The usual sofa sleeper mechanism is provided with a deck formed of a wire link fabric that functions as a yieldable support for the mattress in the bed-forming position of the mechanism. While the wire is quite durable and provides a strong support for the mattress, it has been found to be objectionable from the standpoint of comfort. Also, the wire link fabric has been objected to because it is heavy, abrasive, and difficult to handle.

Furthermore, in the seat-forming position of a mechanism that includes wire link fabric, it has often been necessary to provide fabric overdecking for the wire for aesthetic purposes and to try to prevent the imprinting of a noticeable design on the sofa seat cushions which will sometimes assume the imprint of any article with which they have been in engagement for any length of time. As a consequence of these objections, manufacturers have heretofore sought to replace wire link fabric, but without complete success. Some efforts have been made to replace the wire link with canvas, but canvas is objectionable because it will stretch and bucket and is difficult to maintain in a taut condition.

It is an object of this invention, therefore, to provide an improved deck assembly which overcomes the objections outlined above and also eliminates the need for overdecking under the seat cushions.

SUMMARY OF THE INVENTION

In the deck assembly of this invention, a sheet of polypropylene fabric is provided at its edges with a seam in which border wires are enclosed. The sheet is then mounted on the open sofa sleeper frame by means of the usual coil springs which are hooked into the frame and over the enclosed border wires at the edges of the polypropylene fabric sheet. The wires maintain the fabric in a relatively taut horizontal condition in which the deck provides the desired yieldable support for the bed mattress. When the sofa sleeper frame is moved to its stacked folded position, stored within the sofa frame, the polypropylene fabric forms an excellent support for the usual sofa sleeper cushions.

The polypropylene fabric is strong and, in use, stretches slightly to enhance its capability as a yieldable mattress support, but because it is a synthetic heat treated fiber, the polypropylene deck always returns to its original shape.

It is the principal object of this invention, therefore, to provide an improved deck for sofa sleeper mechanisms that is formed of a polypropylene fabric.

Figure 1:
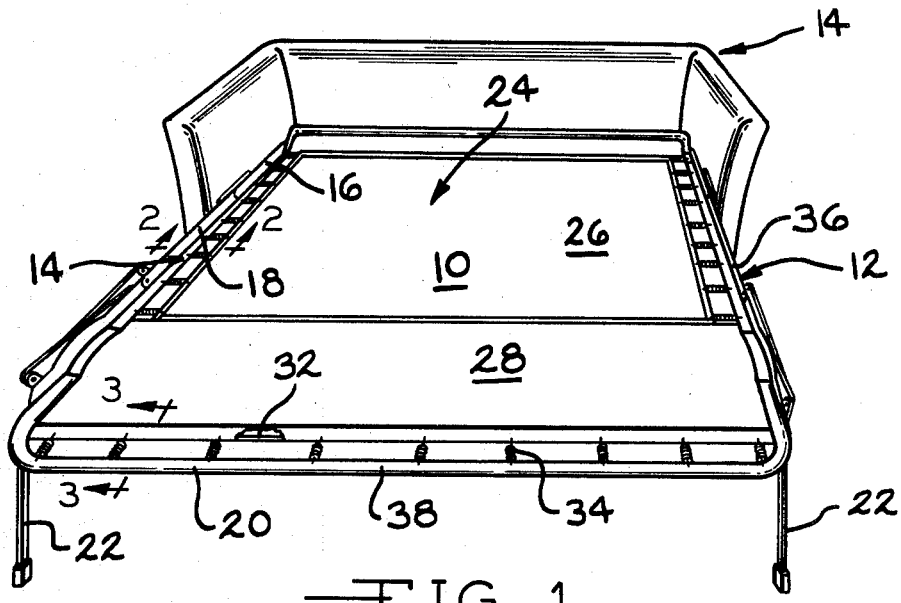
Figure 2:
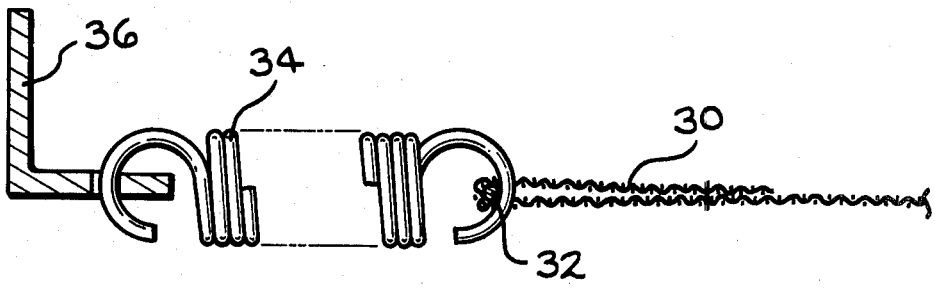
Figure 3:
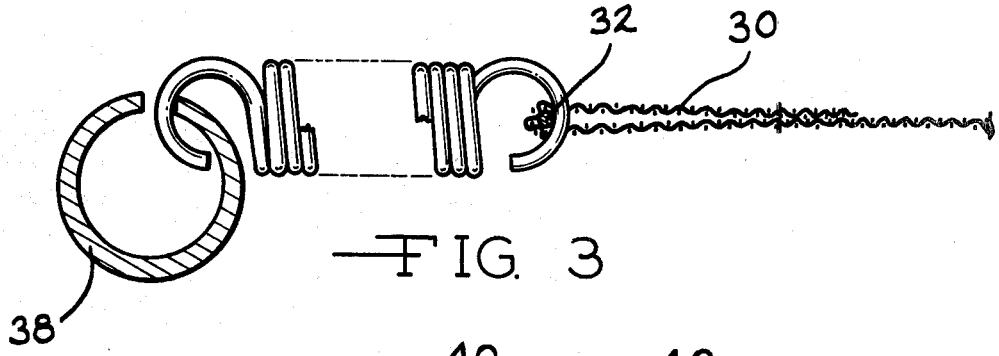
Figure 4:
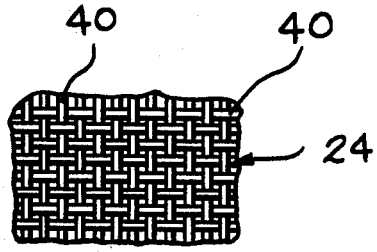

Further objects, features, and advantages of this invention will become apparent from a consideration of the following description, the appended claims, and the accompanying drawing in which:

FIG. 1 is a perspective view of a sofa sleeper mechanism shown in assembly relation with a sofa frame, illustrating the mechanism in its open bed-forming position and provided with the improved deck assembly of this invention;

FIGS. 2 and 3 are enlarged transverse sectional views, as seen from lines 2—2 and 3—3, respectively, in FIG. 1 illustrating the mounting of the improved deck assembly on the sofa sleeper frame; and FIG. 4 is a fragmentary plan view of the polypropylene fabric from which the improved deck assembly of this invention is constructed.

With reference to the drawing, the improved polypropylene fabric deck assembly of this invention, indicated generally at 10, is shown in FIG. 1 incorporated in the mechanism 12 for a sofa sleeper 14. The mechanism 12 includes a foldable frame 14 having a plurality of sections, namely, a head section 16, an intermediate section 18, and a foot section 20 which are hingedly connected and mounted in a conventional manner on the frame (not shown) for the sofa sleeper 14. The hinged connection of the sections 16, 18, and 20 and the mounting of the frame on the sofa sleeper 14 enables the frame 14 to be moved between the bed-forming position shown in FIG. 1, in which the sections 16, 18, and 20 are arranged side by side and a seat-forming position (not shown) in which the sections 16, 18, and 20 are relatively stacked and stored within the sofa sleeper 14. In the seat-forming position of the frame 14, it supports the usual sofa cushions (not shown). U.S. Pat. Nos. 2,352,989 and 3,813,710 disclose sofa sleepers of the general type discussed above and the disclosures in these patents are incorporated herein by reference to avoid burdening this disclosure with details of conventional sofa sleeper structure.

In the bed-forming position of the frame 14, illustrated in FIG. 1, the foot section 20 is supported on legs 22 so that the deck assembly 10 is in a generally horizontal position for supporting the usual sofa mattress (not shown). The deck assembly 10 comprises a sheet 24 of polypropylene fabric which is shown as being in two pieces, 26 and 28, it being understood that the sheet 24 can be one piece or can be made of more than the two pieces illustrated. The sheet 24 is stitched so that it has edge seams 30 at its periphery (FIGS. 2 and 3), and border wires 32 are enclosed within the seams 30. Conventional coil springs 34 are hooked, at one of their ends, into the frame members 36 and 38 that are connected together to form the frame 14. The opposite ends of the springs 34 are hooked over the border wires 32 so as to maintain the sheet 24 in a substantially taut horizontal position on the frame 14 in which it can function effectively as a yieldable support for the conventional sofa sleeper mattress. In a sofa sleeper of the type illustrated in U.S. Pat. No. 2,352,989, in which the mattress support is positioned directly below the sofa sleeper cushions, in the seat-forming position of the mechanism 12, the sheet 24 is also capable of functioning as the overdecking, thus eliminating the need for overdecking.

The sheet 24 is constructed by weaving a plurality of polypropylene fibers or yarns 40 (FIG. 4) which have been heat treated so that they can be stretched when subjected to suitable stress, but when the stress is removed, will return to their original sizes. Polypropylene yarns of this type are conventional and are described in U.S. Pat. No. 3,470,928, the disclosure in which is incorporated herein by reference.

In the use of the deck assembly 10 of this invention, when the frame 14 is in its bed-forming position illustrated in FIG. 1, the polypropylene sheet 24 is in a generally horizontal position and is in relative taut condition so that it will provide the desired yieldable support for the conventional sofa sleeper mattress (not shown). When the mattress is being slept on, the sheet 24 may stretch slightly to accommodate localized loads, but when the loads are removed, the sheet 24 will return to its original taut condition.

Because the sheet 24 is a fabric, it has the ability to function as an overdecking in the seat-forming position of the frame 14 in which the frame sections 16, 18, and 20 are stacked one on top of the other and stored within the sofa sleeper 14. When the sheet 24 functions as overdecking, it provides the necessary yieldable support for the conventional sofa sleeper pillows without imprinting a design in the pillows, as is the case with conventional wire fabric.

From the above description, it is seen that this invention provides an improved sofa sleeper deck assembly 10 which is advantageous because it is formed of a sheet 24 consisting principally of polypropylene fibers 40. The described mounting for the sheet 24 maintains the sheet in a taut condition for best supporting the conventionl sofa sleeper mattress.

What is claimed:

1. In a sofa sleeper mechanism which includes an open foldable frame having relatively movable head, intermediate and foot sections movable to side-by-side, generally horizontal bed-forming positions, a deck assembly mounted on said frame so as to form a yieldable support surface for a mattress or the like in the bed-forming position of the frame, said assembly comprising a unitary sheet constructed principally of woven, heat treated polypropylene fibers, and yieldable means mounted on said frame and attached to said sheet so as to maintain said sheet in a substantially taut horizontal position in the bed-forming position of said frame.

* * * * *